US008876243B2

(12) United States Patent
Nitta

(10) Patent No.: US 8,876,243 B2
(45) Date of Patent: Nov. 4, 2014

(54) INKJET RECORDING DEVICE AND INKJET RECORDING METHOD

(75) Inventor: Noboru Nitta, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 537 days.

(21) Appl. No.: 13/033,558

(22) Filed: Feb. 23, 2011

(65) Prior Publication Data

US 2012/0062639 A1 Mar. 15, 2012

(30) Foreign Application Priority Data

Sep. 13, 2010 (JP) ..... 2010-204782

(51) Int. Cl.
*B41J 29/38* (2006.01)
*B41J 2/175* (2006.01)

(52) U.S. Cl.
CPC ..... *B41J 2/175* (2013.01)
USPC ..... 347/17; 347/85

(58) Field of Classification Search
CPC ..... B41J 11/42; B41J 29/393; B41J 29/38; B41J 3/60; B41J 11/0095
USPC ..... 347/17, 85, 5, 6, 7, 9, 84; 73/861.52
See application file for complete search history.

(56) References Cited

U.S. PATENT DOCUMENTS 6,601,460 B1 * 8/2003 Materna ..... 73/861.52
2005/0219282 A1 10/2005 Kachi
2006/0215000 A1 * 9/2006 Kachi ..... 347/85
2007/0252860 A1 11/2007 Nitta et al.
2008/0158307 A1 * 7/2008 Nitta et al. ..... 347/85
2008/0158320 A1 7/2008 Nitta et al.
2008/0158321 A1 7/2008 Nitta et al.
2008/0238980 A1 * 10/2008 Nagashima et al. ..... 347/17
2009/0040258 A1 * 2/2009 Baek ..... 347/17
2009/0174735 A1 7/2009 Yamada
2009/0195588 A1 * 8/2009 Ogama ..... 347/17

FOREIGN PATENT DOCUMENTS

JP 2005-280246 10/2005
JP 2007-313884 * 6/2007 ..... B41J 2/175
JP 2007-313884 12/2007
JP 2009-178998 8/2009
JP 2010-017928 1/2010

OTHER PUBLICATIONS

Japanese Office Action dated Jul. 9, 2013, filed in Japanese counterpart Application No. 2011-167550 (with English translation).

* cited by examiner

*Primary Examiner* — Manish S Shah
*Assistant Examiner* — Yaovi Ameh
(74) *Attorney, Agent, or Firm* — Patterson & Sheridan LLP

(57) ABSTRACT

According to an embodiment, an inkjet device includes a first temperature sensor which detects an ink temperature in an upstream side of a print head, a second temperature sensor which detects an ink temperature in a downstream side of the print head, and a control device which changes at least one of energies per unit volume of first and second pressure sources, based on the temperatures detected by the first and second temperature sensors.

20 Claims, 4 Drawing Sheets

INKJET RECORDING DEVICE AND INKJET RECORDING METHOD

CROSS-REFERENCE TO RELATED APPLICATIONS

This application is based upon and claims the benefit of priority from Japanese Patent Application No. 2010-204782, filed on Sep. 13, 2010; the entire contents of which are incorporated herein by reference.

FIELD

An embodiment described herein generally relates to an inkjet recording device of a circulation type which discharges ink form nozzles in an inkjet head while circulating the ink, and relates to an inkjet recording method thereof.

BACKGROUND

An inkjet recording device of a circulation type comprises upstream- and downstream-side pressure sources and a print head. While ink is circulated between the upstream-side and downstream-side pressure sources and the print head, the ink is discharged from the nozzles of the print head to perform recording.

However, when a temperature of ink changes, there is a conventional drawback that, for example, the ink wastefully drips from the nozzles or air is suctioned through the nozzles. There are still other drawbacks of instable discharging and degraded print quality when a temperature of ink changes.

DETAILED DESCRIPTION

In general, according to an embodiment, an inkjet device comprises: a first pressure source which contains ink and causes the ink to have an "energy per unit volume" P1 (Pa), relative to, as a standard, "energy per unit volume" of static ink under an atmospheric pressure at a height level of nozzles of a print head; an upstream-side flow channel which connects the first pressure source to the print head; a second pressure source which is connected to the print head through a downstream-side flow channel, contains ink which has passed through the print head, and causes the ink to have an "energy per unit volume" P2 (Pa), relative to the standard; a return flow channel which connects the second pressure source to the first pressure source, thereby constituting a circulation channel; a first temperature sensor which detects an ink temperature in an upstream side of the nozzles of the print head; a second temperature sensor which detects an ink temperature in a downstream side of the nozzles of the print head; and a control device which changes at least one of the energies per unit volume of the first and second pressure sources, based on the temperatures detected by the first and second temperature sensors.

Hereinafter, embodiments will be described in details with reference to the drawings.

First Embodiment

Figure 1:
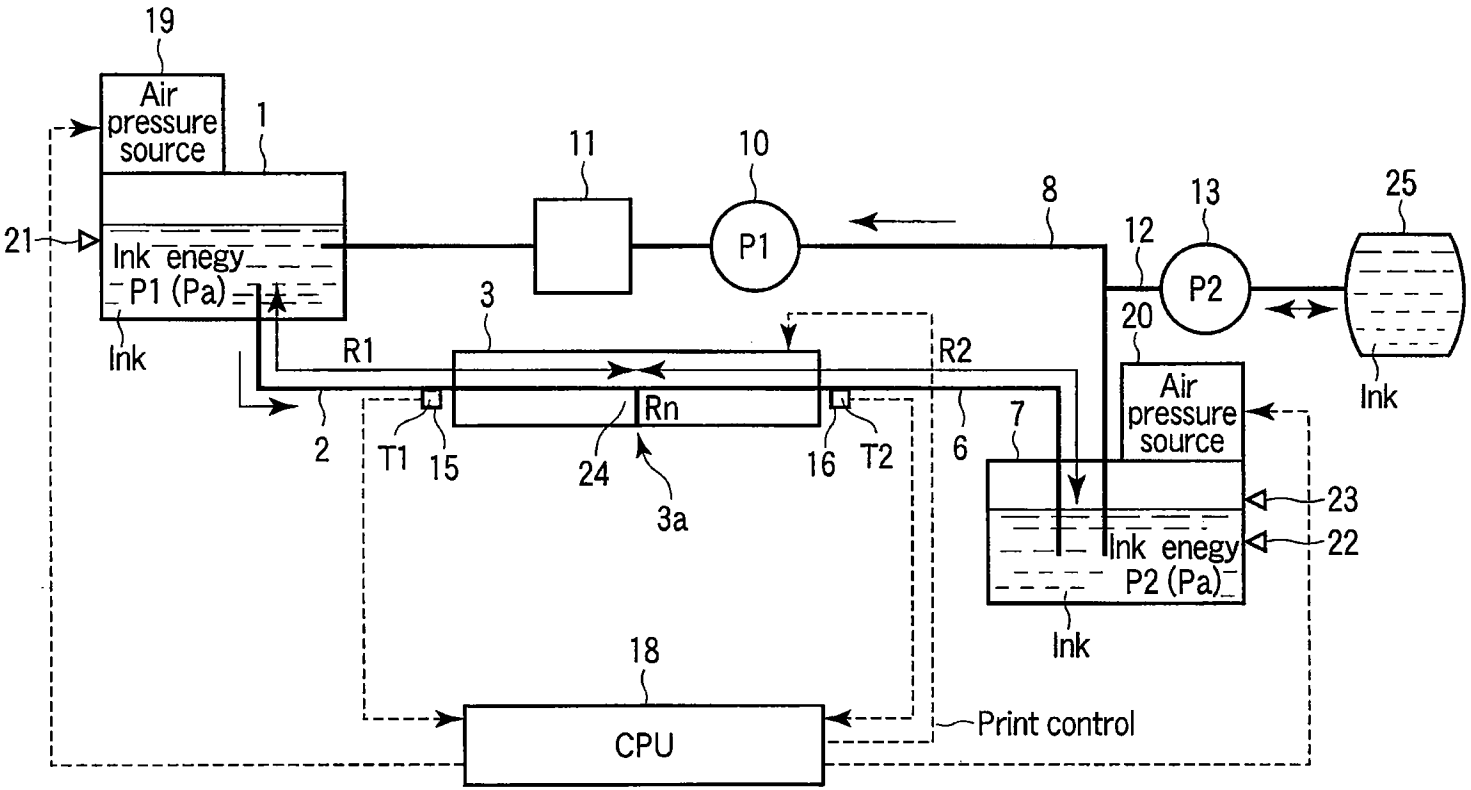
FIG. 1 is a block diagram showing an inkjet device according to a first embodiment.

FIG. 1 shows an inkjet recording device of an ink circulation type according to the first embodiment.

In the figure, reference symbol 1 denotes an upstream-side sub-tank 1 as a first pressure source. A print head 3 is connected to the upstream-side sub-tank 1 through an upstream-side flow channel 2. A downstream-side sub-tank 7 as a second pressure sources is connected to the print head 3 through a downstream-side flow channel 6.

The downstream-side sub-tank 7 is connected to the upstream-side sub-tank 1 through a return flow channel 8. In an intermediate part of the return flow channel 8, a first pump 10 and a filter 11 are provided in this order along a flow direction of ink, thereby constituting a circulation channel.

To an inlet side of the first pump 1, a main tank 25 is connected through an ink-amount adjust channel 12. A second pump 13 is connected to an intermediate part of the ink-amount adjust channel 12.

The main tank 25 may be a volume-variable bag made of a flexible substance. Alternatively, it may be a bottle in which the liquid surface is exposed to the atmospheric pressure.

The first pump 10 is a circulation pump and returns ink from inside of the downstream-side sub-tank 7 to the upstream-side sub-tank 1 when a liquid surface of the ink in the upstream-side sub-tank 1 is detected to be lower than a predetermined height in a gravitational direction by an upper liquid-level sensor 21. The second pump 13 is to control an ink amount and charges ink to the circulation channel from the main tank 25 when a liquid surface of the ink is detected to be lower than a predetermined height by a lower liquid-level sensor 22.

Inversely, the second pump 13 draws the ink from the circulation channel to the main tank 25 when the liquid surface of the ink in the downstream-side sub-tank 7 is detected to be higher than a predetermined height by an upper liquid-level sensor 23.

When lifetime or noise of pumps is to be taken care of due to frequently switching between start and stop or forward and backward rotations of the pumps 10 and 13, a difference as shown in the figure may be set between heights to be detected respectively by the upper liquid-level sensor 23 and lower liquid-level sensor 22, i.e., an appropriate hysteresis may be set.

In a configuration as described above, the first and second pumps 10 and 13 are operated to circulate and supply ink for the print head 3. In the meanwhile, the ink is discharged from nozzles 3*a* of the print head 3 under control of the CPU 18, to perform recording.

In this ink supply system of a circulation type, a nozzle pressure under non-printing or small-amount-printing conditions is determined by energies per unit volumes P1 (Pa) and P2 (Pa) of ink in the upstream- and downstream-side pressure sources and by a flow resistance ratio between upstream and downstream sides. Hereinafter, operation thereof will be described in details.

The energy per unit volume is a total of a pressure energy and a positional energy of ink relative to, as a reference, ink under an atmospheric pressure at a height level of nozzles of the inkjet head, and is expressed in the same unit of Pa (pascal) as a unit for expressing pressures.

A flow channel resistance in the upstream side is R1 (Pa*s/$m^3$), and a flow channel resistance in the downstream side is R2 (Pa*s/$m^3$). An ink flow rate is Q ($m^3$/s), and a nozzle pressure is Pn (Pa). A flow channel resistance from a nozzle branch point 24 to nozzles is Rn, and a flow-channel resistance ratio r is R1:R2=1:r.

A nozzle pressure when a flow rate of ink discharged from the nozzles is sufficiently small is Pn0 (Pa) as follows:

$$Pn0=P1*r/(1+r)+P2/(1+r) \quad (1)$$

$$Q=(P1-P2)/(R1+R2)$$

Further, a pressure source impedance Rs (Pa*s/m$^3$) is as follows:

$$Rs = (\text{parallel resistance of } R1 \text{ and } R2) + Rn$$

$$= \{1/(1/R1*1/R2)\} + Rn$$

When ink is discharged at a maximum flow rate qm (m$^3$/s), the nozzle pressure Pn1 is as follows:

$$Pn1=Pn0-qm*Rs \quad (2)$$

The flow rate of ink discharged from the nozzles takes an arbitrary value between 0 (m$^3$/s) and a maximum value (m$^3$/s). Therefore, the nozzle pressure takes an arbitrary value between Pn0 (Pa) and Pn1 (Pa) depending on content of printing.

Accordingly, Pn0 need be selected to be below an upper limit of a proper range of the nozzle pressure, and Pn1 need be above a lower limit of a proper range of the nozzle pressure.

If the proper range of the nozzle pressure is narrow, flow channels of individual parts may be designed to be large diameter and short length so as to decrease flow channel resistance of the individual parts and so as to reduce a value of Rs, to approximate Pn1 to Pn0.

The temperature of ink varies depending on environmental temperatures and conditions heat generation of actuators. When the temperature of ink changes, the viscosity thereof then changes. The flow channel resistance is proportional to the viscosity of ink.

The value of the foregoing expression (1) is a function of a ratio r between flow channel resistances in the upstream and downstream sides. Since the value of the expression (1) does not depend on individuals of the flow channel resistances, the nozzle pressure Pn does not change even when a temperature of the ink changes, insofar temperatures of the ink are uniform from the upstream-side pressure source to the downstream-side pressure source through the print head.

However, if temperatures of the ink in the upstream and downstream sides is different, the ratio r between the flow channel resistances changes. As a result, the nozzle pressure Pn varies.

If the nozzle pressure Pn varies, discharge quality such as stability of ink discharge operation, a discharge amount, or a discharge speed changes. As a result, print quality should be degraded.

The individual temperatures of the ink in the upstream and downstream sides can differ in cases as described below.

Ink having a high viscosity should sometimes be required to use. In this case, for example, the ink is warmed in a region constituting the upstream-side pressure source 1. The warmed ink is cooled down by flow channels and the head, and reaches the downstream-side pressure source 7. Therefore, the ink temperature in the upstream side goes high and the ink temperature in the downstream side goes lower than in the upstream side. Accordingly, the nozzle pressure Pn increases and thereby, print quality degrades or ink leaks from the nozzles.

Other cases will now be considered. In one other case, for example, if a large amount of heat is generated by actuators nearby the nozzles of the print head 3, the ink is heated by print head 3 and cooled down naturally or forcibly, while the ink is circulated through downstream-side flow channel 6, downstream-side pressure source 7, return flow channel 8, upstream-side pressure source 1, and upstream-side flow channel 2.

In above cases, the ink temperature is highest in the region of the actuators. The closer to the downstream-side pressure source 7, the lower the ink temperature in the downstream-side flow channel. On the other side, the temperature of ink in the upstream-side flow channel is almost as same as a temperature of the upstream-side pressure source 1, and lower than the temperature of the ink in the downstream-side flow channel. As a result, the nozzle pressure Pn decreases and thereby, print quality degrades or air tends to be drawn from the nozzles.

According to the present embodiment, variation of the nozzle pressure Pn caused by the temperature difference between the upstream and downstream side flow channels is compensated for. Therefore, discharge of ink and print quality can be maintained constantly even when the ink temperatures in the upstream and downstream sides change independently from each other.

Next, the temperature sensors and operation using the same will be described.

Upstream- and downstream-side temperature sensors 15 and 16 are respectively provided at upstream side and downstream side of the print head 3.

The position of these sensors 15 and 16 should be selected so that these sensors should detect representing temperature, of each of the upstream-side flow channel 2 and the downstream-side flow channel 6. These positions are, for example, nearby an upstream inlet port and a downstream outlet port of the print head 3.

Figure 2:
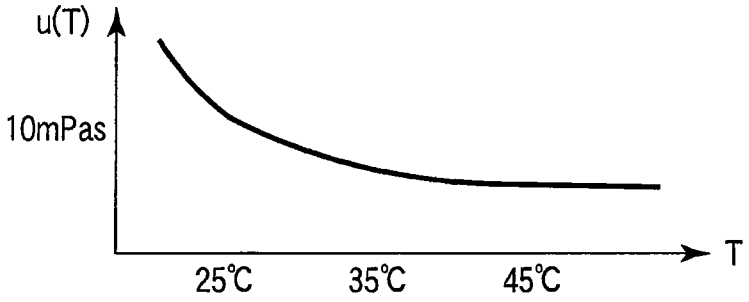
FIG. 2 is a graph showing a relationship between an ink temperature and an ink viscosity in the inkjet device in FIG. 1.

A relationship as shown in FIG. 2 exists between a temperature T and a viscosity u (T) of the ink. The viscosity u (T) of the ink decreases as the temperature T of the ink increases.

The upstream- and downstream-side temperature sensors 15 and 16 each are connected to the CPU 18 as a control device 18. Ink temperatures detected by the upstream- and downstream-side temperature sensors 15 and 16 are transferred to the CPU 18.

Air pressure sources 19 and 20 of the upstream and downstream sub-tanks 1 and 7 each are also connected to the CPU 18 to control air pressures of the air pressure sources 19 and 20.

The air pressure of the air pressure source 19 is equal to a pressure at an air-liquid interface in the upstream-side sub-tank 1. The air pressure of the air pressure source 20 is equal to a pressure at an air-liquid interface in the downstream sub-tank 7. Therefore, the "energies per unit volume" P1 (Pa) and P2 (Pa) of ink in the upstream and downstream sides can be controlled by controlling the air pressures of the air pressure sources 19 and 20.

T1 denotes a temperature detected by the upstream-side temperature sensor 15, and represents a temperature of the ink in the upstream side. T2 denotes a temperature detected by the downstream-side temperature sensor 16, and represents a temperature of the ink in the downstream side.

Where the temperatures are respectively T1 and T2, the viscosity u (T) (Pa*s) and the upstream-side flow-channel resistance R1 and downstream-side flow channel resistance R2 form a relationship as follows.

Where flow channel resistances per viscosity in the upstream and downstream sides are d1 and d2 (1/m$^3$), the upstream-side flow channel resistance R1 (Pa*s/m$^3$)=d1*u (T1), and the downstream-side flow channel resistance R2 (Pa*s/m$^3$)=d2*u (T2).

The flow channel resistance per viscosity is expressed in units of 1/m$^3$ and depends on a shape of a channel. At this time, the flow-channel resistance ratio r is r=R2/R1={d2/d1}*{u(T2)/u(T1)}. If detected temperatures T2 and T1 are not equal to each other, the value of the flow channel resistance ratio changes in accordance with a ratio of u(T2)/u(T1).

The CPU 18 hence adjusts and controls at least one of P1 (Pa) and P2 (Pa) so as to constantly maintain the nozzle pressure Pn=P1*r/(1+r)+P2/(1+r), based on change of the flow channel resistance ratio r.

Thus, according to the present embodiment, at least one of P1 (Pa) and P2 (Pa) is controlled so as to constantly maintain the nozzle pressure Pn when temperatures of ink have changed. Therefore, none of drawbacks of degraded print quality, wasteful dripping of ink from the nozzles and suctioning of air takes place but excellent printing is available without influencing a discharge volume or print quality.

If both of P1 (Pa) and P2 (Pa) are adjusted, the flow rate Q=(P1−P2)/(R1+R2) also can be maintained, more desirably, constant while maintaining the value of Pn.

Second Embodiment

Figure 3:
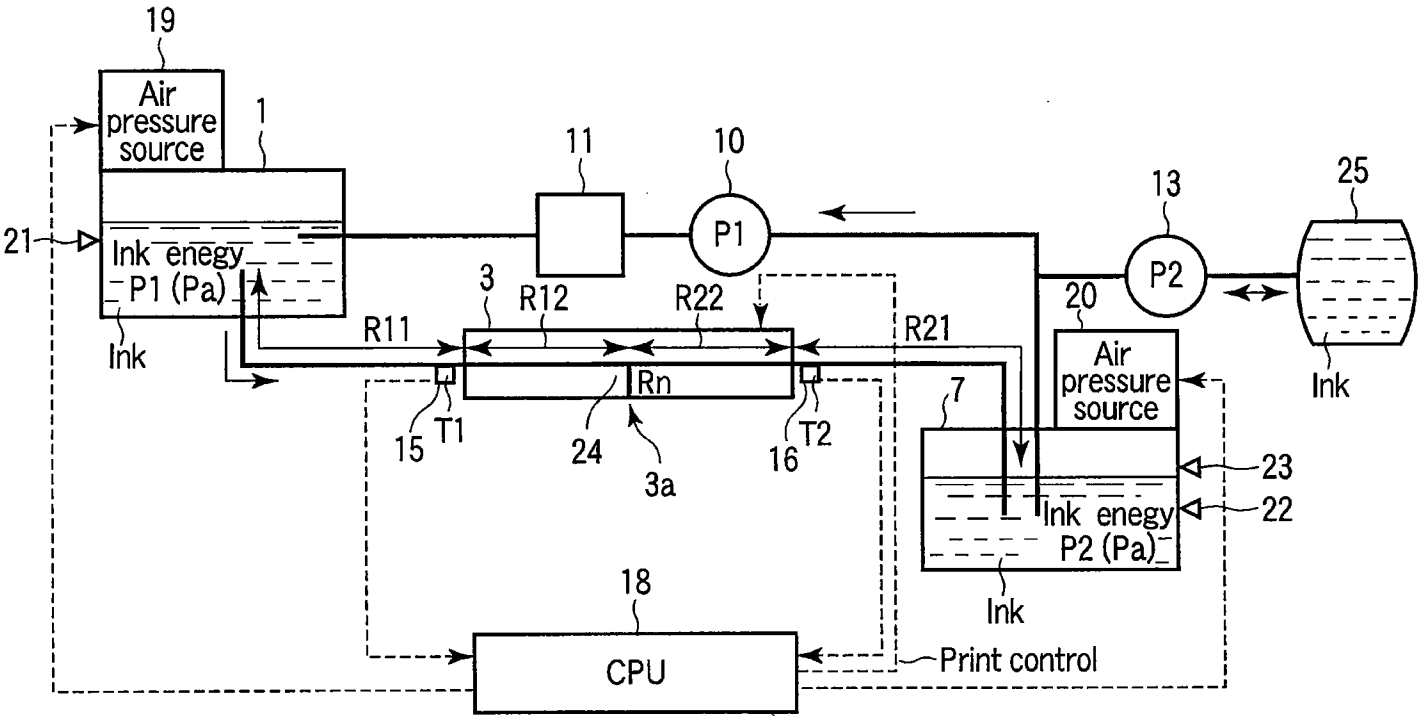
FIG. 3 is a block diagram showing an inkjet device according to a second embodiment.

FIG. 3 is a block diagram showing an inkjet recording device according to the second embodiment.

The same parts as described in the above first embodiment will be denoted at the same reference symbols as well, and detailed descriptions thereof will be omitted herefrom.

The second embodiment relates to a case that a print head 3 is so small that an inner temperature distribution is considered to be substantially uniform, and heat sources mainly exist in the print head 3, and the ink is cooled down mainly on the downstream-side pressure source 7, return flow channel 8, or the upstream-side pressure source 1.

In the second embodiment, upstream- and downstream-side flow-channel resistances are each divided into resistances inside and outside the print head 3. Outside and inside upstream-side flow-channel resistances are respectively expressed as R11 (Pa*s/m$^3$) and R12 (Ra*s/m$^3$). Outside and inside downstream-side flow-channel resistances are respectively expressed as R21 (Pa*s/m$^3$) and R22 (Pa*s/m$^3$).

On this condition, an ink temperature at an upstream port of the print head 3 to an upstream-side pressure source 1 is substantially T1, and an ink temperature at a flow channel from an upstream port of the print head 3 to a downstream-side pressure source 7 is substantially T2. Therefore, the followings may be considered.

$$R11=d11*u(T1)$$

$$R12=d12*u(T2)$$

$$R22=d22*u(T2)$$

$$R21=d21*u(T2)$$

$$R1=R11+R12$$

$$R2=R22+R21$$

Here, d11 to d22 are respectively flow channel resistances per viscosity (1/m3) at individual regions, and depend on shapes of flow channels.

Excellent printing is available as in the foregoing first embodiment by controlling at least one of P1 (Pa) and P2 (Pa) so as to maintain the nozzle pressure Pn at a predetermined value.

Third Embodiment

Figure 4:
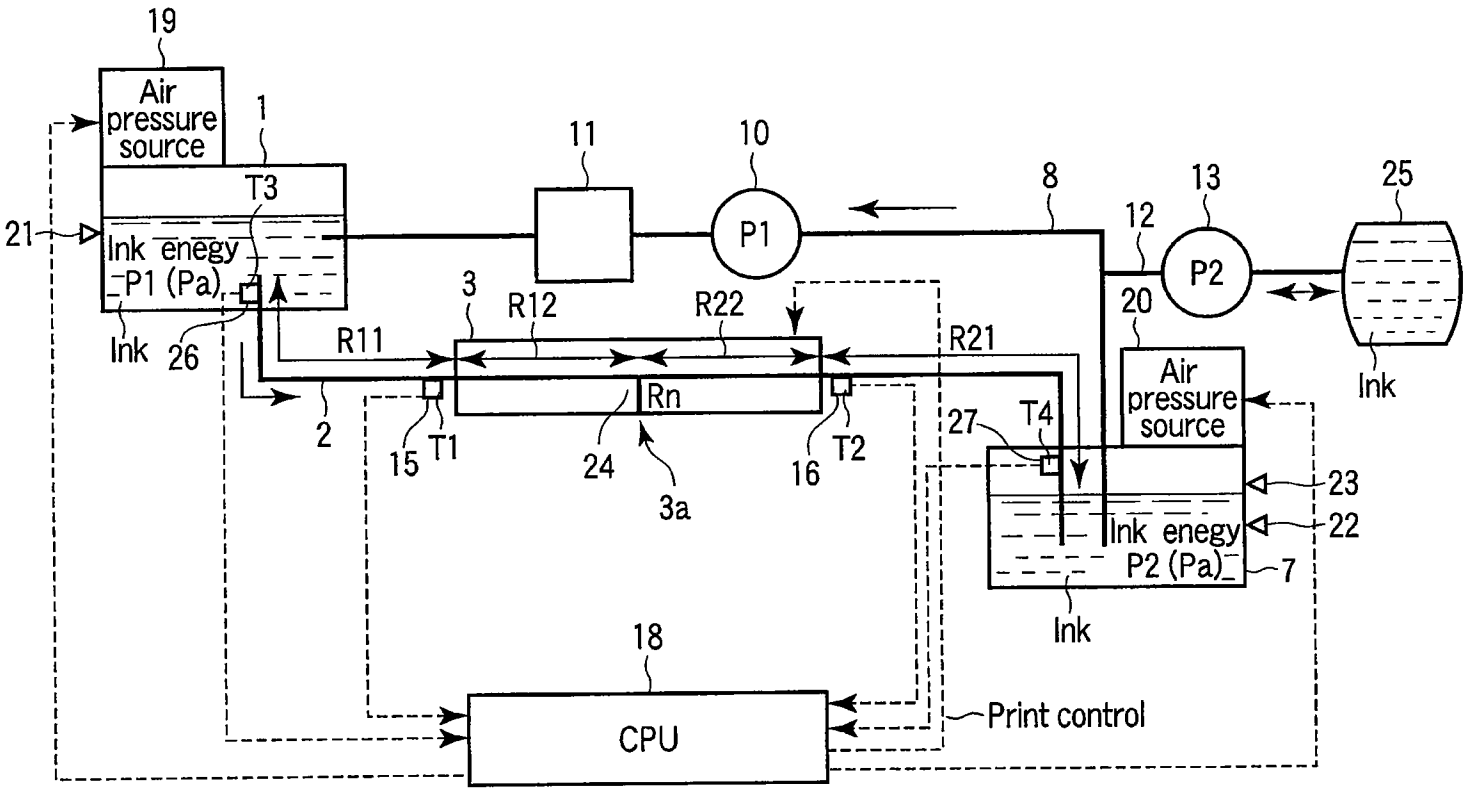
FIG. 4 is a block diagram showing an inkjet device according to a third embodiment.

FIG. 4 is a block diagram showing an inkjet recording device according to the third embodiment.

The same parts as described in the above second embodiment will be denoted at the same reference symbols as well, and detailed descriptions thereof will be omitted herefrom.

In the third embodiment, temperature sensors 26 and 27 which detect ink temperatures T3 and T4 are respectively added to an upstream-side pressure source 1 and a downstream-side pressure source 7.

The third embodiment is applicable to a case that a temperature gradient from the upstream-side pressure source 1 to an upstream port of the print head 3 is not negligible, and a case that a temperature gradient from a downstream port of the print head 3 to the downstream-side pressure source 7 is not negligible.

According to the third embodiment, R11 and R21 are obtained as follows.

Where temperatures are supposed to linearly change along upstream-side and downstream-side flow channels respectively corresponding to R11 and R12:

$$R11=d11*\{1/(T3-T1\}\}*\int_{T1}^{T3}u(T)dt$$

$$R21=d21*\{1/(T4-T2\}\}*\int_{T2}^{T4}u(T)dt$$

When the print head 3 has a so small size as to have a uniform temperature distribution inside the print head 3 and heat sources are mainly exist in the print head 3, R11 and R12 are obtained as follows, like in the foregoing second embodiment.

$$R12=d12*u(T2)$$

$$R22=d22*u(T2)$$

On the other side, for example, ink tanks are heated for use when highly viscous ink is used. In such a case, main heat sources do not exist in the print head 3, and the temperature distribution is not uniform inside the print head 3.

When the print head 3 thus do not include main heat sources and the temperature distribution inside the print head 3 is not uniform, R12 and R22 may be obtained as follows.

Estimated Nozzle Temperature $$TN=(T1-T2)/2+T2$$

$$R12=d12*\{1/(T1-TN\}\}*\int_{TN}^{T1}u(T)dt$$

$$R22=d22*\{1/(TN-T2\}\}*\int_{T2}^{TN}u(T)dt$$

More desirably, an estimated temperature increase KN caused by heat generation of actuators in a nozzle region may be added to the expression of TN, to obtain:

$$TN=(T1-T2)/2+T2+KN$$

KN can be estimated from an energy consumed by the actuators in the head and from a frequency of driving the actuators.

Here, the followings are obtained as well.

$$R1=R11+R12$$

$$R2=R22+R21$$

As in the forgoing embodiment, at least one of P1 (Pa) and P2 (Pa) may be adjusted so as to maintain a nozzle pressure Pn at a predetermined value.

Accuracy of a nozzle pressure can be improved by adding temperature detection units upon necessity. On the contrary, costs can be reduced by omitting temperature detection units.

With a configuration as described above, the nozzle pressure can be maintained at an optimal value, and print quality can be maintained good, and the nozzles 3*a* can be prevented from wastefully dripping ink or suctioning air. If the configuration is employed together with temperature compensation for a drive waveform which will be described later, changes in print quality or in discharge amount which depend on temperatures can be suppressed, and stable printing can be performed even when temperatures are changing.

The temperature compensation for a drive waveform may be performed as follows.

When a temperature of ink changes, temperatures of actuators change accordingly. Then, not only the viscosity of the ink nearby the actuators change but also drive efficiency of the actuators change. Then both of these affect discharge characteristics if the drive waveform for the actuators is not maintained.

In order to maintain constant discharge characteristics even when temperatures change, a drive waveform may be adjusted in accordance with temperatures. For example, as ink temperature increase, efficiency of actuators usually improves and a viscosity of ink decreases to allow the ink to be easily discharged. In this case, the drive waveform should be maintained so that a drive voltage is decreased. At this time, the drive voltage is a function of the nozzle temperature TN described previously. This function may be obtained in advance by carrying out an experiment for measuring a relationship between the nozzle temperature TN and the drive voltage which is required to discharge a predetermined discharge volume by use of a print head and ink which are to be put to actual use.

While certain embodiments have been described, these embodiments have been presented by way of example only, and are not intended to, limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet recording device comprising:

a first pressure source which contains ink and causes the ink to have a first energy per unit volume relative to a reference static ink under atmospheric pressure at a height level of nozzles of a print head;

an upstream-side flow channel which connects the first pressure source to the print head;

a second pressure source which contains ink which has passed through the print head, and causes the ink to have a second energy per unit volume relative to the reference static ink;

a downstream-side flow channel which connects the print head to the second pressure source;

a return flow channel which connects the second pressure source to the first pressure source and completes a circulation channel;

a first temperature sensor;

a second temperature sensor; and a control device which changes at least one of the energies per unit volume of the first and second pressure sources, the print head comprising a nozzle branch point which connects the upstream-and downstream-side flow channels to the nozzles, the first temperature sensor configured to detect an ink temperature of ink that is upstream of the nozzle branch point, the second temperature sensor configured to detect an ink temperature of ink that is downstream of the nozzle branch point, and the control device configured to maintain an ink pressure in the nozzles at a predetermined value by controlling at least one of the first and second energies per unit volume based on a flow channel resistance ratio of a flow channel resistance of the upstream-side flow channel and a flow channel resistance of the downstream-side flow channel, the flow channel resistances being determined based on the temperatures detected by the first and second temperature sensors.

2. The inkjet recording device of claim 1, wherein the flow channel resistances are based on a viscosity-to-temperature characteristic of the ink.

3. The inkjet recording device of claim 1, wherein the first temperature sensor comprises a plurality of first temperature sensors, and the control device maintains ink pressure in the nozzles at the predetermined value, based on temperatures detected by the plurality of first temperature sensors, the temperature detected by the second temperature sensor, and a viscosity-to-temperature characteristic of the ink.

4. The inkjet recording device of claim 1, wherein the second temperature sensor comprises a plurality of second temperature sensors, and the control device maintains the ink pressure in the nozzles at the predetermined value, based on temperatures detected by the plurality of second temperature sensors, the temperature detected by the first temperature sensor, and a viscosity-to-temperature characteristics of the ink.

5. The inkjet recording device of claim 1, further comprising:

a first pump provided on the return flow channel;

a main tank connected to an inlet side of the first pump through an ink-amount adjustment channel; and a second pump provided on the ink-amount adjustment channel.

6. The inkjet recording device of claim 5, wherein the first pump pumps ink from the second pressure source to the first pressure source so that a height of a liquid surface of the ink in the first pressure source is maintained lower than a predetermined height, and the second pump pumps the ink from the main tank into the circulation channel or pumps the ink back to the main tank, depending on a height of a liquid surface of the ink in the second pressure source.

7. The inkjet recording device of claim 1, wherein the control device controls a pump to adjust a height of the liquid surface of the ink in one of the first pressure source and the second pressure source so that the ink pressure in the nozzles is maintained at the predetermined value.

8. An inkjet recording device comprising:

a first pressure source which contains ink and causes the ink to have an energy per unit volume P1 relative to a reference static ink under atmospheric pressure at a height level of nozzles of a print head;

an upstream-side flow channel which connects the first pressure source to the print head;

a second pressure source which contains ink which has passed through the print head, and causes the ink to have an energy per unit volume P2 relative to the reference static ink;

a downstream-side flow channel which connects the print head to the second pressure source;

a return flow channel which connects the second pressure source to the first pressure source and completes a circulation channel;

a flow channel resistance ratio calculation device which calculates a flow channel resistance ratio r between a flow channel resistance R1 ($Pa*s/m^3$) of the upstream-side flow channel and a flow channel resistance R2 ($Pa*s/m^3$) of the downstream-side flow channel, according to a relationship of R1:R2 =1:r, the flow channel resistances R1 and R1 being determined based on a temperature distribution of the ink; and a control device which controls at least one of P1 and P2 in accordance with the calculated flow-channel resistance ratio r, so that a nozzle pressure Pn is maintained at a predetermined value calculated according to an expression of Pn=P1*r/(1+r)+P2/(1 +r).

9. The inkjet recording device of claim 8, wherein the flow channel resistance ratio r is based on at least an ink temperature detected in ink that is upstream of the nozzles of the print head, an ink temperature detected of ink that is downstream of the nozzles of the print head, and a viscosity characteristic of the ink.

10. The inkjet recording device of claim 8, wherein the temperature distribution of the ink in at least one of the upstream and downstream flow channels is determined based on temperatures separately detected in each of a plurality of parts of the at least one of the upstream and downstream flow channels.

11. The inkjet recording device of claim 8, further comprising:

a first pump provided on the return flow channel;

a main tank connected to an upstream side of the first pump through an ink-amount adjustment channel; and a second pump provided on the ink-amount adjustment channel.

12. The inkjet recording device of claim 11, wherein the first pump pumps ink from the second pressure source to the first pressure source so that a height of a liquid surface of the ink in the first pressure source is maintained lower than a predetermined height, and the second pump pumps the ink from the main tank into the circulation channel or pumps the ink back to the main tank, depending on a height of a liquid surface of the ink in the second pressure source.

13. An inkjet recording method comprising:

causing ink contained in a first pressure source to have a first energy per unit volume relative to a reference static ink under atmospheric pressure at a height level of nozzles of a print head connected to the first pressure source;

storing ink which has passed through the print head, in a second pressure source, and causing the ink in the second pressure source to have a second energy per unit volume, relative to the reference static ink;

pumping ink from the second pressure source to the first pressure source through a return flow channel, thereby circulating the ink;

detecting a first ink temperature of ink that is upstream of the nozzles of the print head;

detecting a second ink temperature of ink that is downstream of the nozzles of the print head; and controlling at least one of the first and second energies per unit volume based on a flow channel resistance ratio of a flow channel resistance of an upstream-side flow channel between the first pressure source and the print head, and a flow channel resistance of a downstream-side flow channel between the print head and the second pressure source, the flow channel resistances being determined based on the first and second detected ink temperatures.

14. The inkjet recording method of claim 13, further comprising:

controlling at least one of the first and second energies per unit volume to maintain an ink pressure in the nozzles at a predetermined value, based on the first and second detected ink temperatures and on a viscosity-to-temperature characteristic of the ink.

15. The inkjet recording method of claim 13, further comprising:

detecting plurality of first ink temperatures at different positions between the nozzles and the first pressure source; and controlling at least one of the first and second energies per unit volume to maintain an ink pressure in the nozzles at a predetermined value, based on the detected first ink temperatures, the detected second ink temperature, and on a viscosity-to-temperature characteristic of the ink.

16. The inkjet recording method of claim 13, further comprising:

detecting a plurality of second ink temperatures at different positions between the nozzles and the second pressure source; and controlling at least one of the first and second energies per unit volume to maintain an ink pressure in the nozzles at a predetermined value, based on the detected first ink temperature, the detected second ink temperatures, and on a viscosity-to-temperature characteristic of the ink.

17. The inkjet recording method of claim 13, wherein the ink is pumped from the second pressure source to the first pressure source so that a height of a liquid surface of the ink in the first pressure source is maintained lower than a predetermined height.

18. The inkjet recording method of claim 13, wherein the ink is pumped from or to a main tank, depending on a height of a liquid surface of the ink in the second pressure source.

19. An inkjet recording method comprising:

causing ink contained in a first pressure source to have a first energy per unit volume relative to a reference static ink under atmospheric pressure at a height level of nozzles of a print head connected to the first pressure source;

storing ink which has passed through the print head, in a second pressure source, and causing the ink in the second pressure source to have a second energy per unit volume, relative to the reference static ink;

pumping ink from the second pressure source to the first pressure source through a return flow channel, thereby circulating the ink;

detecting a first ink temperature of ink that is upstream of the nozzles of the print head;

detecting a second ink temperature of ink that is downstream of the nozzles of the print head; and maintaining an ink pressure in the nozzles at a predetermined pressure by controlling at least one of the first and second energies per unit volume, based on a flow channel resistance ratio of a flow channel resistance of an upstream-side flow channel between the first pressure source and the print head, and a flow channel resistance of a downstream-side flow channel between the print head and the second pressure source, the flow channel resistances being determined based on the first and second detected ink temperatures.

20. The inkjet recording method of claim 19, wherein the step of maintaining the ink pressure comprises:

controlling a pump to adjust a height of the liquid surface of the ink in one of the first pressure source and the second pressure source so that the ink pressure in the nozzles is maintained at the predetermined value.

* * * * *